US006290083B1

(12) United States Patent
Witter et al.

(10) Patent No.: US 6,290,083 B1
(45) Date of Patent: Sep. 18, 2001

(54) HEATING SYSTEM FOR TANKS FOR ASSEMBLY FOR SUPPORTING THE FLOATING ROOFS OF TANKS FOR STORING LIQUIDS

(75) Inventors: Aldyr Witter, deceased, late of Sao Leopoldo, by Roger Vieira Witter, legal representative; Luis Adolfo Velloso Pradel, Porto Alegre, both of (BR)

(73) Assignee: Petroleo Brasileiro S.A., Petrobras (BR)

( * ) Notice: Subject to any disclaimer, the term of this patent is extended or adjusted under 35 U.S.C. 154(b) by 0 days.

(21) Appl. No.: 09/030,362

(22) Filed: Feb. 25, 1998

(Under 37 CFR 1.47)

(30) Foreign Application Priority Data

Feb. 25, 1997 (BR) ..... 9701072

(51) Int. Cl.[7] ..... B65D 88/34; B65D 88/40
(52) U.S. Cl. ..... 220/220; 220/216
(58) Field of Search ..... 220/216, 220, 220/218, 221, 226, 567, 567.2, 217, 219, 222, 223, 224, 225, 227

(56) References Cited

U.S. PATENT DOCUMENTS

| | | | | |
|---|---|---|---|---|
| 1,493,091 | | 5/1924 | Wiggins . | |
| 2,735,574 | * | 2/1956 | Williams | 220/220 |
| 3,319,329 | * | 5/1967 | Knutsen et al. | 220/220 |
| 3,583,594 | * | 6/1971 | Belanger et al. | 220/220 |
| 3,587,911 | * | 6/1971 | Creith | 220/220 |
| 3,815,775 | * | 6/1974 | Strunc et al. | 220/220 |
| 5,230,436 | | 7/1993 | Vaughn . | |
| 5,353,941 | | 10/1994 | Benvegnu et al. . | |
| 5,449,084 | * | 9/1995 | Wade | 220/220 |
| 5,628,421 | * | 5/1997 | Jolly | 220/220 |

* cited by examiner

*Primary Examiner*—Allan N. Shoap
*Assistant Examiner*—Niki M. Eloshway
(74) *Attorney, Agent, or Firm*—Nixon & Vanderhye PC

(57) ABSTRACT

An assembly for supporting the floating roof of a tank is provided that includes a guide fastened to the floating roof, a support leg slidably received in the guide and a locking pin. The guide supports the floating roof when the assembly is in an operating mode. In this mode, the support leg may be withdrawn from the guide. When the support leg is withdrawn, the locking pin is installed coaxial with the vertical axis of the guide, to close the orifice remaining upon removal of the support leg. When the roof is placed in a maintenance mode, the support leg is reinserted in the orifice and the locking pin is passed through aligned orifices of plates rigidly fastened to the top end of the guide. The transverse orientation of the locking pin in the locked mode enables an operator to determine the operating status of the floating roof.

10 Claims, 4 Drawing Sheets

HEATING SYSTEM FOR TANKS FOR ASSEMBLY FOR SUPPORTING THE FLOATING ROOFS OF TANKS FOR STORING LIQUIDS

FIELD OF THE INVENTION

The present invention relates to an assembly for supporting the floating roofs of tanks for storing liquid products, particularly petroleum and its derivatives.

PRIOR ART

Storage tanks are widely used in the petroleum industry and are essential to the functioning of an operational unit. They may be intended, for example, for storing crude oil, intermediate products or final products.

Given the highly volatile nature of these products, these storage tanks have a roof capable of floating over the stored liquid, as a way of preventing the undesirable accumulation of gases between the layer of liquid and the roof.

The floating roof should in no way touch the bottom of the tank, as this would risk causing damage to the installations. It is therefore necessary to limit its travel to prevent it reaching a level which is below a specific minimum height, referred to by specialists as the "minimum operating height".

On occasions, it is necessary for the floating roof to be stationed at a specific higher level to enable workmen to enter the tank in order to carry out maintenance operations, this height being referred to by specialists as the "maintenance height".

A minimum operating height is established which prevents the roof coming into contact with the layer of sludge which is generally deposited on the floor of the storage tank. In some situations, this minimum operating height represents 20% of the total height of the storage tank. If the level of liquid stored drops below this height, support legs of the roof touch the floor of the tank and prevent the roof from descending further.

These support legs slide inside guides which are rigidly fastened to the floating roof and make it possible to adjust the operating and maintenance heights of the floating roof. The support legs have at least two transverse orifices which are intended to receive locking pins. The guides also have orifices for the locking pins. In order to adjust the height of the support leg, it is necessary to align the orifice of the guide with one of the orifices of the support leg and to slip in a locking pin through the aligned orifices.

Depending on the size and the weight of each support leg, the height-adjustment operation requires the participation of at least two people, one for handling the leg and the other for inserting the pin into the correct orifice. It is not uncommon for this operation to require three people.

In the storage tanks which are currently used, the difference between the maintenance and operating heights is relatively small since, as stated above, the layer of sludge which has accumulated in the bottom of the tank is generally very thick and requires a high operating height.

Our International Patent Application No. PCT/BR 97/00022 proposes the use of a tank floor whose centre is located at a level below the level of the edges, with a view to concentrating the undesirable liquids which are to be drained off (normally water) in the central region of the bottom of the tank. A ramp conveys the undesirable liquids to the edges of the tank. Automatic or manual drainage systems, as suggested in International Patent Application No. PCT/BR 97/00050, make it possible to draw off all the undesirable liquids. Consequently, the layer of sludge is now an extremely rare phenomenon.

With the adoption of these new technologies, the floating roof of the tank may therefore descend to a position which is much closer to the floor of the tank, because the layer of sludge has been eliminated.

However, another problem arises. As the difference between the maintenance and minimum operating heights of the floating roof is now a relatively high value, somewhere of the order of two metres, if use is made of traditional support legs then when the roof reaches the operating height practically the entire length of the leg is located above the roof, in a manner similar to a post.

Such an occurrence is undesirable and may even damage the support legs, which may for example buckle, so in a situation of this type their fastening to the guides is fairly unreliable. One possible solution would be to strengthen both the legs and the guides, which would give rise to an undesirable increase in the weight of the assembly and, consequently, of the floating roof.

U.S. Pat. No. 5,353,941 proposes a support assembly which employs an easy-to-handle adjustable-height system. This type of leg solves the problem regarding adjustment of the maintenance height. The main drawback of this system lies in the fact that the support legs are in permanent contact with the product being stored throughout the period during which the tank is in operation. This significantly reduces the service life of the support legs, owing to the effects of the corrosion to which they are exposed.

OBJECT OF THE INVENTION

The present invention proposes the use of an assembly for supporting floating roofs which requires the use of support legs only when the roof is in maintenance mode.

SUMMARY OF THE INVENTION

The present invention is characterised in that it comprises:

a) a guide which is substantially vertical and hollow in the longitudinal direction and is rigidly fastened to a floating roof which it is desired to support, wherein the lower end of the guide acts as a support for the floating roof when the roof reaches the lowest position;

b) a support leg which comprises a substantially vertical column having in an upper part a stop which acts as a travel limiter and prevents the support leg from moving downwardly and falling inside the tank beyond a first position when the leg is installed inside the guide;

c) a pair of mutually aligned orifices in the guide above the position of the support leg stop when the support leg is in the first position; and d) a locking pin able to be inserted through the aligned orifices to prevent upward movement of the support leg from the first position; wherein, when it is necessary to place the assembly in the maintenance mode, the shaft of the locking pin is passed through the orifices.

In order to place the floating roof in maintenance mode, the locking pin has to be inserted in the orifices of the guide, with its longitudinal axis perpendicular to the longitudinal axis of the support leg. The locking pin now acts as an element for locking the support leg.

The position of the locking pins allows remote visual indication of the operating status of the floating roof.

BRIEF DESCRIPTION OF THE DRAWINGS

The characteristics of the present invention will be better understood on the basis of the detailed description which will be given hereinbelow, purely by way of example, in combination with the accompanying drawings which are an integral part of the present specification, and in which.

DESCRIPTION OF A PREFERRED EMBODIMENT

Before beginning the detailed description of the invention, reference will be made to FIG. 1, which shows a floating roof equipped with support legs which have been constructed in accordance with known techniques, this Figure being useful for an understanding of the present invention.

Figure 1B:
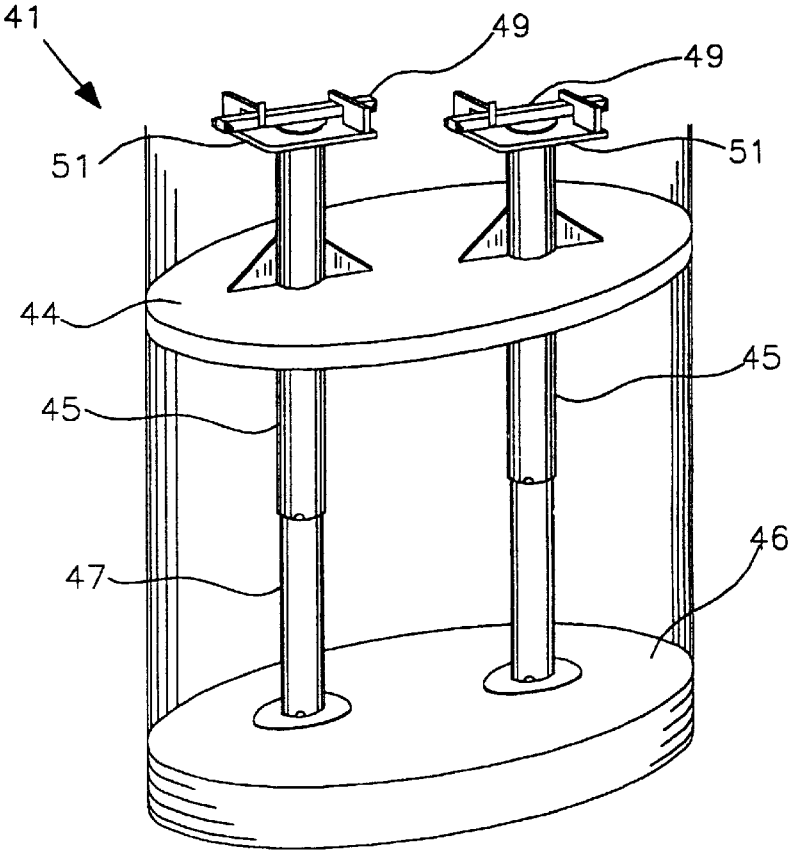
FIG. 1b (Prior Art)
FIGS. 1*a* and 1*b* are diagrammatic representations of a tank whose floating roof is supported using conventional (prior art) techniques.
Figure 1A:
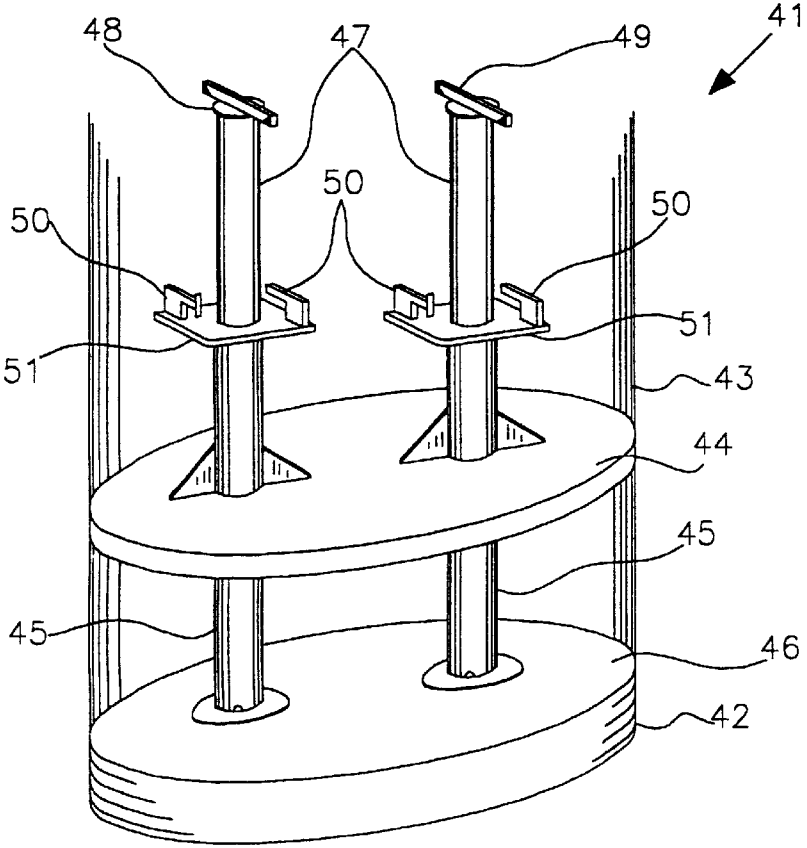
FIG. 1a (Prior Art)

FIG. 1*a* shows a diagrammatic representation of a storage tank 41 which has a side wall 43 and is installed on a foundation ring 42.

Inside the tank is a floating roof 44 which is supported by guides 45 resting on the floor 46 of the tank 41. The floating roof 44 is shown at the minimum operating height.

The guides 45 are hollow columns, which makes it possible for support legs 47 to pass inside them. Plates 51 are rigidly fastened to the top of the guides 45. These plates 51 have two diagonally mounted lugs 50, the function of which is to lock the support legs, as will be seen hereinbelow.

On its upper end, each of the support legs 47 has a disc 48 to which a locking bar 49 is fastened, the locking bar being a fundamental component for locking the support leg 47.

When the tank 41 is in operation, these support legs 47 have no structural function at all; they only slide inside the guides 45, and only act as an element for sealing the longitudinal interior spaces of these guides 45.

In order to place the floating roof 44 in maintenance mode as shown in FIG. 1*b*, the support legs 47 have to be locked in a position in which they are secured to the guides 45. To this end it is sufficient to apply a 90° rotation to the support leg 47, so that the locking bar 49 engages inside the lugs 50.

The major disadvantage with this system of supporting floating roofs arises from the fact that the support legs are permanently mounted on the guides, without fulfilling any structural function at all for the greater part of the time. The legs are unnecessarily in contact with the product, and will suffer the effects of corrosion.

A further problem to be taken into account is that it is difficult for an operator to ascertain, from the top of the side wall 43, which position the support legs are in-i.e. in the operating position or in the maintenance position. This means the operator has to climb on to the top of the floating roof and inspect the support legs individually in order to check their position, particularly when the tank is in maintenance mode.

Figure 2A:
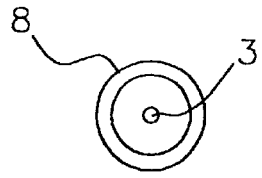
FIG. 2*a* is a detail section taken on the line C—C of FIG. 2.
Figure 2:
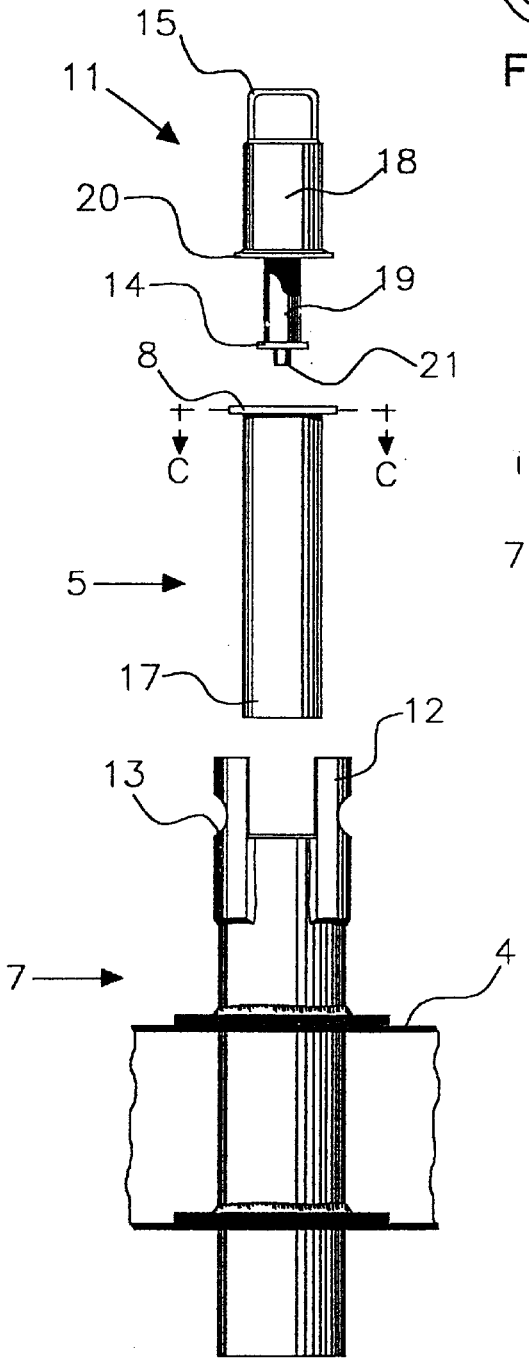
FIG. 2 is an exploded side view of the assembly according to the present invention for supporting the floating roofs of tanks for storing liquids, in which the principal components are shown.
Figure 3:
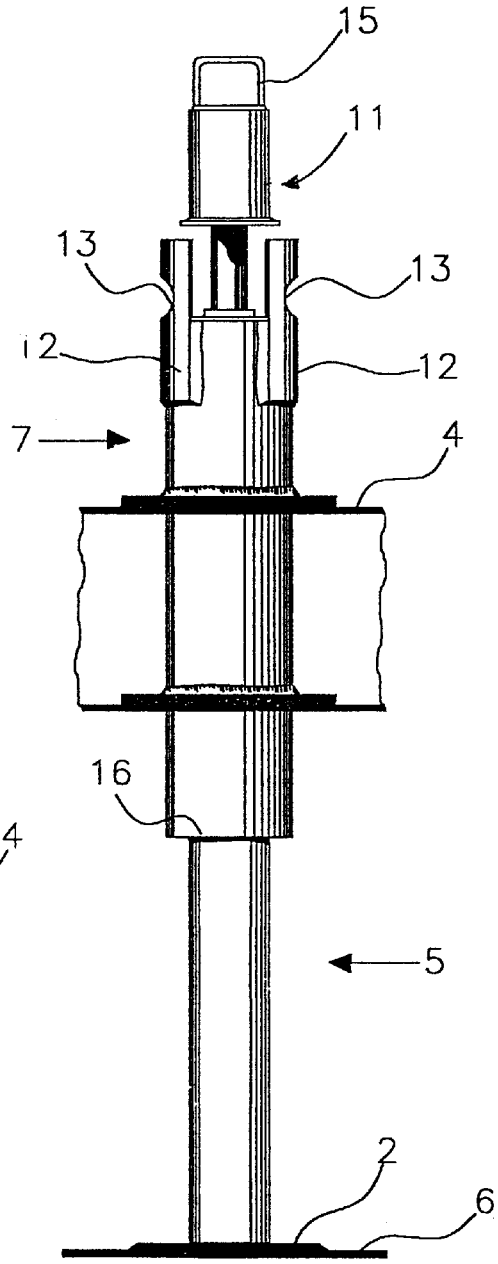
FIG. 3 is a side view of the assembly of FIG. 2 which has been adjusted to operate with the storage tank in operating mode.

FIGS. 2 and 3 show a side view of a detail of a form of the assembly constructed in accordance with the present invention. Basically this comprises a guide 7, a support leg 5 and a locking pin 11. In FIG. 2, these components are shown in an exploded form, only to facilitate comprehension. In FIG. 3, they are shown as adapted for a tank operating in operating mode.

Purely for the purposes of simplification, the Figures show only one leg assembly for supporting the floating roof. However, a plurality of assemblies will normally be employed to support the floating roof of a storage tank, and the number will depend on the size of the tank or on the weight of the floating roof.

The guide 7 is rigidly fastened to the floating roof which it is desired to support. Purely by way of example the Figures show a double-skin or double deck type floating roof 4. The guide 7 is substantially vertical and has a longitudinal hollow interior so as to receive the support leg 5 for longitudinal relative movement, e.g. by sliding. Two plates 12, in the form of cylindrical segments, are rigidly fastened to the upper end of the guide 7. These plates 12 have orifices 13, which are mutually aligned and which are intended to allow the passage of the locking pin 11, as will be seen hereinbelow.

The support leg 5 basically comprises a substantially vertical column 17 which has external dimensions chosen to enable it to be installed and to slide inside the hollow guide 7. On the upper end of the column 17 is a stop 8 which acts as a travel limiter and prevents the support leg 5 from falling inside the tank.

The support leg 5 has means for fastening the locking pin 11. In the present embodiment, there is a threaded orifice 3 in the centre of the stop 8, for fastening the locking pin 11 to the support leg 5 as will be described hereinbelow.

The locking pin 11 comprises a body 18 which has at the lower end a flange 20. The upper end of the body 18 has means which enable the locking pin 11 to be handled firmly; in the present embodiment this is a handle 15.

A shaft 19 has one of its ends rigidly fastened to the bottom of the body 18, coaxial with the axis of symmetry of this body 18. At the other end of the shaft 19 is a flange acting as a stop 14. The locking pin 11 has means which enable it to be fastened to the support leg 5. In the present embodiment there is a threaded pin 21 rigidly fastened to the stop 14.

In FIG. 3, the assembly is in a random operating position (i.e. not necessarily in the minimum operating position). It may be seen that the threaded pin 21 of the locking pin 11 is screwed into the threaded orifice 3 of the buffer 8. Consequently, the support leg 5 and the locking pin 11 are secured together. If it were desired, for example, to withdraw the support leg 5 from within the hollow guide 7, it suffices to pull upwardly on the handling means 15 of the locking pin 11.

It should be pointed out that the locking pin 11 may be fastened to the support leg 5 by any other means, the threaded pin 21 and the threaded orifice 3 having been selected in the present embodiment as this is regarded as the most suitable arrangement.

Figure 4:
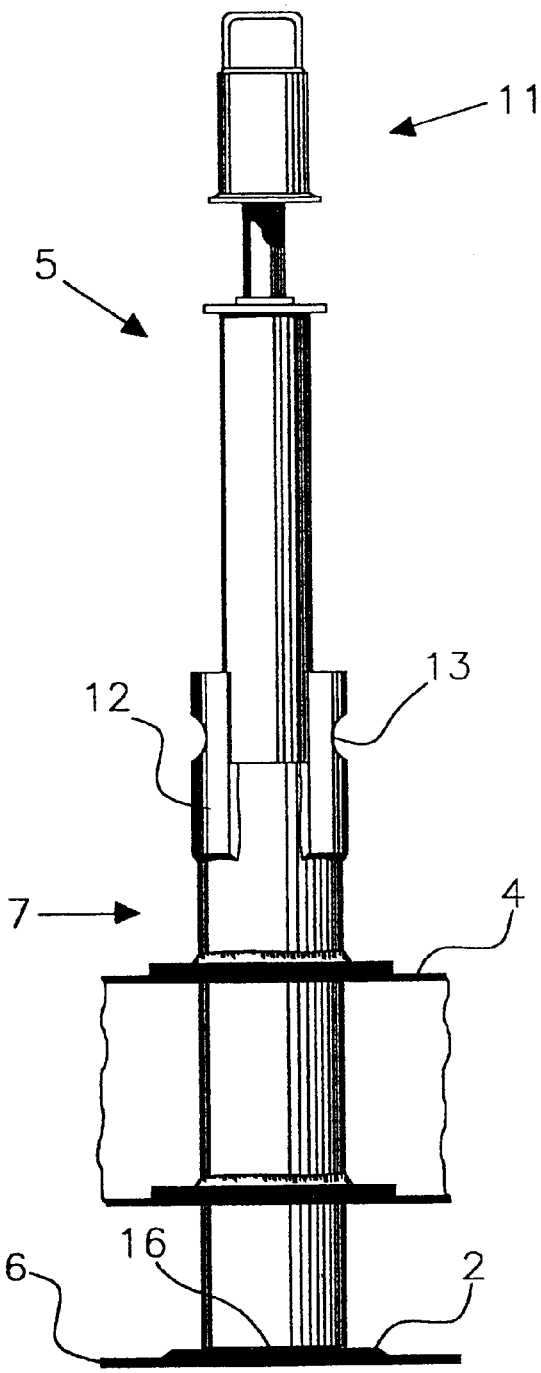
FIG. 4 is a side view of the assembly of FIG. 2 in a position in which the bottom of the guide is resting on the floor of the tank.

The guide 7 acts as a support for the floating roof 4 when the roof has descended as far as the lowest operating position. When such a situation occurs, the lower end 16 of the guide 7 rests on the floor 6 of the tank, as shown in FIG. 4. Generally speaking, use is made of reinforcements 2 on the floor 6 at the points where the guide 7 rests, as a way of increasing the strength of the tank floor 6.

Although the assembly for supporting the floating roofs of tanks for storing liquids is composed of the three principal components described above (the guide 7, the locking pin 11 and the support leg 5), the present invention makes it possible, optionally, at times to dispense with use of the support leg, which has a structural function only when the floating roof 4 is in the maintenance mode.

Figure 5:
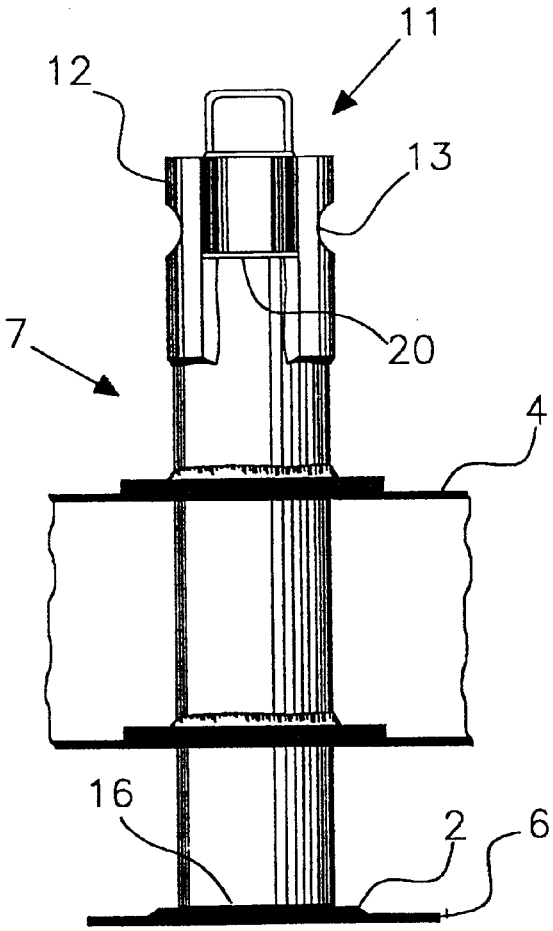
FIG. 5 is a side view of the assembly of FIG. 2 when the support leg is not being used and the bottom of the guide is resting on the bottom of the tank.

FIG. 5 shows a side view of the assembly in a situation in which the support leg 5 is not being used. It may be seen that the locking pin 11 is resting on the top of the guide 7 and the flange 20 of the pin is sealing the longitudinal orifice of the guide 7 through which the support leg 5 would pass, so as to prevent undesired communication between the inside of the tank and the outside. The bottom of the flange 20, which comes into contact with the guide 7, may be coated or lined with some sealing material.

This removal of the support leg 5 is a significant characteristic of the present invention and permits a major cost reduction. It is possible, for example, to store a small number of support legs to satisfy the need to carry out maintenance on a large number of storage tanks.

In addition, the service life of the support legs increases since unnecessary contact between the legs and the liquid product stored when the tank is in operation is avoided. By taking such measures, the corrosive effects of the liquid product on the material of which the support legs are made are practically eliminated.

Figure 6:
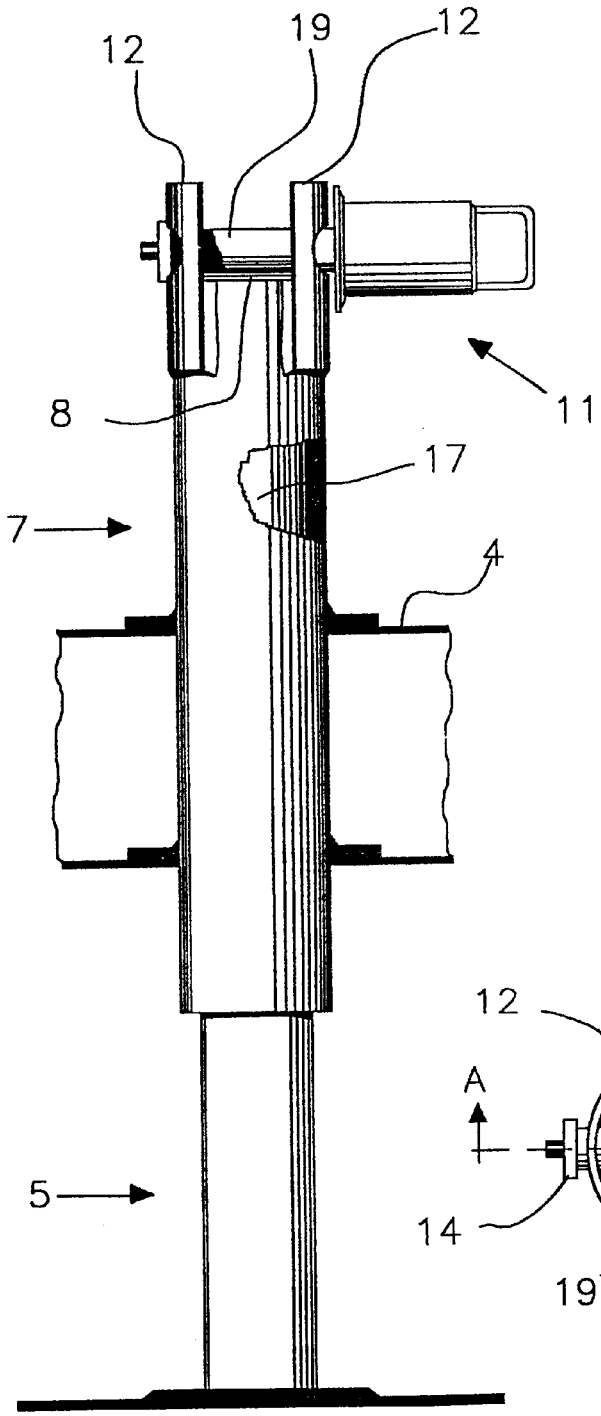
FIG. 6 is a side view of the assembly of FIG. 2 when adjusted to operate with a storage tank in the maintenance mode.

When it is necessary to place the floating roof 4 in the maintenance mode, the roof has to be raised up to a level at which the support legs hang down and rest on their stops 8. The locking pin 11 is then extracted from the top of the support leg 5 and its shaft 19 is then passed through the orifices 13 of the plates 12, as shown in FIG. 6.

Figure 7A:
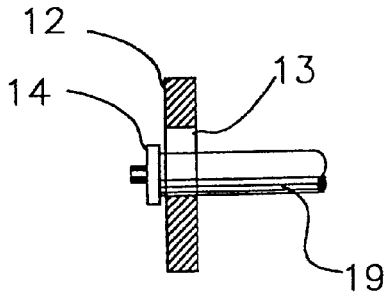
FIG. 7*a* is a detail section taken on the line A—A of FIG. 7.
Figure 7:
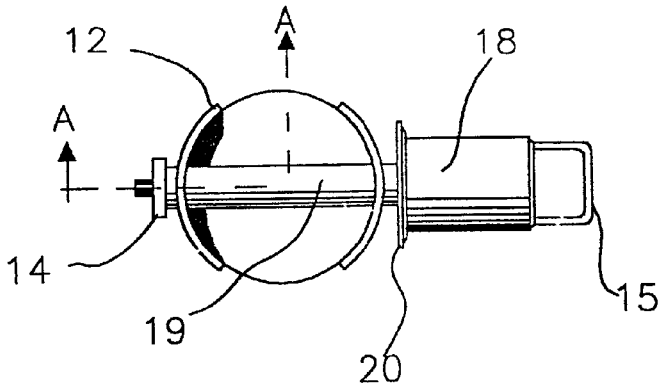
FIG. 7 is a top view of a locking pin in the position in which it locks the support leg.

The orifices 13 have dimensions which permit the passage of the stop 14 of the shaft 19 with a slight clearance. The shaft 19 rests on the lower peripheries of the orifices 13, since its length is such that the stop 14 passes through the entire gap between the plates 12 and passes to the external side, as may be seen in FIG. 7.

The flange 20 has dimensions which are greater than those of the orifices 13 and it acts as a stop limiting travel of the locking pin 11. As the stop 14 has dimensions which are greater than the dimensions of the shaft 19, as may be seen in detail in FIG. 7*a* which is a section taken on line A—A of FIG. 7, the locking pin 11 is prevented from moving longitudinally in either direction and it then acts as a stop for the support leg 5, as may be seen in FIG. 6, enabling the floating roof 4 to be supported.

In addition to the two functions described above, the locking pin 11 has a third function: that of indicating to a remote observer the status of the floating roof assembly support, i.e. whether it is in the operating mode or in the maintenance mode, as will be seen hereinbelow.

While the floating roof is in the operating mode, the locking pin 11 will always remain in the vertical position, coaxial with the longitudinal axis of the guide 7, irrespective of whether the support leg 5 is present or not.

When the floating roof 4 is in the maintenance mode, the locking pin 11 is in a position which is transverse to the longitudinal axis of the guide 7.

Therefore, simple observation of the position of the locking pin 11 enables an operator to determine from a distance the operating status of each assembly for supporting floating roofs. This observation may, for example, be made from a high, tank-side platform, it then being unnecessary for the operator to descend on to the floating roof to check the status of each of the support assemblies, an operation which may be hazardous, owing to the large dimensions of the storage tanks.

Optionally, the locking pin 11 may be painted with some type (colour) of paint to facilitate remote observation, which would further facilitate the operator's task.

In conclusion, the present invention has major advantages in comparison with the prior art, since it permits a significant reduction in the costs of installing or modernizing tank facilities, in addition to having the characteristic of indicating, to a remote observer, the operational status of the storage tank.

What is claimed is:

1. An assembly for supporting a floating roof of a tank for storing liquids, comprising:

a guide having an upper end and a lower end, said guide being substantially hollow in the longitudinal direction thereof and being rigidly fastened to a floating roof to be supported thereby, said guide being fixed to said roof so as to extend in a direction substantially perpendicular to a plane of said roof and so that said lower end projects downwardly from a bottom surface of said roof and said upper end projects upwardly from an upper surface of said roof, whereby when said floating roof reaches a lowest position thereof within the tank, said lower end of said guide supports said floating roof;

a support leg comprising a substantially vertical column sized so as to be slidably received within said hollow guide, said support leg having a first, lower end for being received into said hollow guide and a second, upper end, said support leg further comprising a first stop structure provided adjacent said second end thereof, said guide including a second stop structure complementary to said first stop structure for engaging the same to limit insertion of said support leg into said guide;

a lock receptacle extending vertically upwardly from said second stop structure, said lock receptacle defining a pair of mutually aligned orifices; and a locking component for selectively engaging said lock receptacle to limit upward movement of said support leg relative to said guide;

wherein said locking component comprises a main body including a handle to allow manually grasping thereof; a flange; a locking pin shaft extending in a direction generally perpendicular to a plane of said flange; a fastening structure at a free end of said locking pin shaft for selectively fastening to said second end of said support leg; and a locking pin stop adjacent said fastening structure;

wherein said locking pin shaft and said locking pin stop are sized for being slidably disposed through said aligned orifices, but said flange of said locking component has a transverse dimension greater than the transverse dimension of said orifices thereby to define a travel limiter for limiting insertion of said locking component, a length of said locking pin shaft being such that when said locking pin shaft extends through said orifices and across a space between said orifices, said locking pin stop is disposed on a diametrically opposite side of said lock receptacle with respect to said flange, whereby said locking pin shaft defines a vertical stop for said support leg that limits upward movement of said support leg relative to said guide.

2. An assembly according to claim 1, wherein said lock receptacle comprises two plates, each in the form of a part cylindrical segment and each rigidly fastened at the upper end of said guide, and having said mutually aligned orifices therein.

3. An assembly according to claim 1, wherein said support leg is removable from said guide and wherein with the support leg removed, said fastening structure of said locking component can be coupled to the upper end of said guide, with said flange closing an upper end orifice of said guide, so as to prevent undesired communication between an inside of said tank with an exterior of said tank.

4. An assembly according to claim 3, wherein a bottom of said flange which comes into contact with the upper end of said guide is covered with a sealing material.

5. An assembly according to claim 1, wherein said first stop structure has fastening structure complementary to said locking component fastening structure for fastening said locking component to said support leg.

6. An assembly according to claim 5, wherein said locking component fastening structure is a threaded pin rigidly fastened to said locking pin stop, and said complementary fastening structure of said first stop structure is a threaded orifice; whereby, when it is necessary to fasten said locking component to said support leg, said threaded pin is secured into said threaded orifice.

7. An assembly according to claim 5, wherein said locking component is vertically oriented when fastened to said support leg second end and said locking component is horizontally oriented when received in said aligned orifices whereby the position of said locking structure gives a remote observer a visual indication of an operational status of the assembly.

8. An assembly according to claim 7, wherein said locking component is painted with a conspicuous paint to enable it to be seen from a distance.

9. An assembly according to claim 1, wherein said locking component is vertically oriented when fastened to said support leg second end and said locking component is horizontally oriented when received in said aligned orifices, whereby the position of said locking component gives a remote observer a visual indication of an operational status of the assembly.

10. An assembly according to claim 9, wherein said locking component is painted with a conspicuous paint to enable it to be seen from a distance.

* * * * *

UNITED STATES PATENT AND TRADEMARK OFFICE

CERTIFICATE OF CORRECTION

PATENT NO. : 6,290,083 B1
DATED : September 18, 2001
INVENTOR(S) : Witter et al.

It is certified that error appears in the above-identified patent and that said Letters Patent is hereby corrected as shown below:

Title page,
Item [54], should read -- [54] ASSEMBLY FOR SUPPORTING THE FLOATING ROOFS OF TANKS FOR STORING LIQUIDS --

Signed and Sealed this

Sixth Day of August, 2002

*Attest:*

*Attesting Officer*

JAMES E. ROGAN
*Director of the United States Patent and Trademark Office*